US011944860B2

(12) United States Patent
Cho

(10) Patent No.: US 11,944,860 B2
(45) Date of Patent: Apr. 2, 2024

(54) ROPE FASTENER, EXERCISE EQUIPMENT USING ROPE FASTENER, FRAME FOR EXERCISE AID, AND EXERCISE AID INCLUDING FRAME FOR EXERCISE AID

(71) Applicant: FIND YOUR BEAUTY, Seoul (KR)

(72) Inventor: Saehanbyul Cho, Seongnam-si (KR)

(73) Assignee: FIND YOUR BEAUTY, Seoul (KR)

( * ) Notice: Subject to any disclaimer, the term of this patent is extended or adjusted under 35 U.S.C. 154(b) by 238 days.

(21) Appl. No.: 17/431,104

(22) PCT Filed: May 26, 2021

(86) PCT No.: PCT/KR2021/006525
§ 371 (c)(1),
(2) Date: Aug. 13, 2021

(87) PCT Pub. No.: WO2021/256718
PCT Pub. Date: Dec. 23, 2021

(65) Prior Publication Data

US 2022/0305322 A1 Sep. 29, 2022

(30) Foreign Application Priority Data

Jun. 15, 2020 (KR) ..... 10-2020-0072433
Jan. 26, 2021 (KR) ..... 10-2021-0010951
Apr. 8, 2021 (KR) ..... 10-2021-0045626

(51) Int. Cl.
*A63B 21/055* (2006.01)
*A63B 21/00* (2006.01)
*A63B 21/04* (2006.01)

(52) U.S. Cl.
CPC ..... *A63B 21/0557* (2013.01); *A63B 21/0442* (2013.01); *A63B 21/0555* (2013.01); *A63B 21/4033* (2015.10); *A63B 2225/09* (2013.01)

(58) Field of Classification Search
CPC ..... A63B 21/0557; A63B 21/0442; A63B 21/0555; A63B 21/4033; A63B 2225/09;
(Continued)

(56) References Cited

U.S. PATENT DOCUMENTS 3,636,946 A * 1/1972 Hardy ..... A63B 21/04 601/134
7,112,178 B1 * 9/2006 Roozenburg ..... A63B 21/4033 601/19

(Continued)

FOREIGN PATENT DOCUMENTS

CN 205268886 U 6/2016
KR 20-0417047 Y1 5/2006

(Continued)

OTHER PUBLICATIONS

Beaurit, "How to use Beurit tools properly (at home pilate)". accessible online at «https://www.youtube.com/watch?v=4TZLZo_836g». Upload date Mar. 4, 2020.

*Primary Examiner* — Andrew S Lo
(74) *Attorney, Agent, or Firm* — NKL LAW; Jae Youn Kim

(57) ABSTRACT

A rope fastener includes an insert inserted into a hollow in an end portion of a rope in an elastic tubular form to expand an outer diameter of the rope, a fixing part that is disposed behind the insert and that includes a boss protruding from a front surface thereof and having an insert recess into which an end of the rope is inserted, and a coupling part having a hollow into which the rope is inserted together with the insert and a rear end portion coupled to the boss of the fixing part.

6 Claims, 20 Drawing Sheets

(58) Field of Classification Search
CPC ..... A63B 21/0552; A63B 21/4035; A63B 21/4034; A63B 21/055; A63B 21/00; A63B 21/02; A63B 21/16; A63B 21/4015; A63B 21/4019; A63B 71/0036
See application file for complete search history.

(56) References Cited

U.S. PATENT DOCUMENTS

| | | | | |
|---|---|---|---|---|
| 7,628,735 | B1 | 12/2009 | Hsu | |
| 9,345,921 | B2 * | 5/2016 | Dye | A63B 21/0004 |
| D901,032 | S * | 11/2020 | Gonglach | D24/211 |
| 11,000,447 | B2 * | 5/2021 | Kokakis | A63B 21/4043 |
| 11,013,658 | B1 * | 5/2021 | Brawley | A61H 15/0092 |
| 11,071,885 | B2 * | 7/2021 | Hadley | A61H 15/0092 |
| D941,482 | S * | 1/2022 | Thompson, Jr. | D24/211 |
| 2005/0113221 | A1 * | 5/2005 | Dovner | A63B 21/0552 482/121 |
| 2005/0113222 | A1 * | 5/2005 | Dovner | A63B 21/00043 482/121 |
| 2011/0009248 | A1 * | 1/2011 | Bronston | A63B 21/153 482/124 |
| 2012/0035029 | A1 * | 2/2012 | Dye | A63B 21/4033 482/132 |
| 2012/0322633 | A1 * | 12/2012 | Holman | A63B 21/0555 482/123 |
| 2013/0213408 | A1 * | 8/2013 | Andrews | A63B 21/4019 128/846 |
| 2013/0324382 | A1 * | 12/2013 | Wilson | A61H 7/007 482/142 |
| 2014/0031183 | A1 * | 1/2014 | Blake | A63B 21/04 482/130 |
| 2014/0270924 | A1 * | 9/2014 | Savarino | A63B 21/0557 403/291 |
| 2017/0043200 | A1 * | 2/2017 | Hall | A63B 22/18 |
| 2018/0326254 | A1 * | 11/2018 | Earls | A63B 26/003 |
| 2019/0009130 | A1 * | 1/2019 | Safar | A63B 26/003 |
| 2019/0118028 | A1 * | 4/2019 | Mancias | A63B 26/003 |
| 2019/0175977 | A1 * | 6/2019 | Miri-Ghomizadeh | A63B 21/00185 |
| 2020/0069993 | A1 * | 3/2020 | Kumelis | A63B 21/008 |
| 2022/0118307 | A1 * | 4/2022 | Chapman | A63B 21/0442 |
| 2022/0233912 | A1 * | 7/2022 | Fowler | A63B 22/20 |

FOREIGN PATENT DOCUMENTS

| | | | |
|---|---|---|---|
| KR | 20-0423409 | Y1 | 8/2006 |
| KR | 20-0424182 | Y1 | 8/2006 |
| KR | 20-2012-0002413 | U | 4/2012 |
| KR | 10-1435180 | B1 | 8/2014 |
| TW | 567871 | U | 12/2003 |

* cited by examiner

ROPE FASTENER, EXERCISE EQUIPMENT USING ROPE FASTENER, FRAME FOR EXERCISE AID, AND EXERCISE AID INCLUDING FRAME FOR EXERCISE AID

TECHNICAL FIELD

The present disclosure relates to a rope fastener, exercise equipment using a rope fastener, a frame for an exercise aid, and an exercise aid including a frame for an exercise aid.

BACKGROUND ART

Recently, more and more people are doing exercises such as yoga, fitness, and Pilates for various purposes such as beauty, stress relief, fatigue recovery, and health promotion.

However, people who find it difficult to make time to go to a fitness center, a yoga center, or a Pilates center due to personal schedules, people who find it difficult to frequently visit a fitness center, a yoga center, or a Pilates center due to a long distance thereto, and people who cannot afford to go to a fitness center, a yoga center, or a Pilates center easily give up despite the need for exercise.

Accordingly, an exercise aid enabling a user to easily follow Pilates and home training motions at home using a simple structure is required.

DETAILED DESCRIPTION OF THE INVENTION

Technical Problem

Various embodiments of the present disclosure have been made to solve the above-mentioned problems occurring in the prior art. An aspect of the present disclosure provides a rope fastener, exercise equipment using a rope fastener, a frame for an exercise aid, and an exercise aid including a frame for an exercise aid that enable a user to easily follow Pilates and home training motions at home.

The technical problems to be solved by the present disclosure are not limited to the aforementioned problems, and any other technical problems not mentioned herein will be clearly understood from the following description by those skilled in the art to which the present disclosure pertains.

Technical Solution

According to an aspect of the present disclosure, a rope fastener includes an insert inserted into a hollow in an end portion of a rope in an elastic tubular form to expand an outer diameter of the rope, a fixing part that is disposed behind the insert and that includes a boss protruding from a front surface thereof and having an insert recess into which an end of the rope is inserted, and a coupling part having a hollow into which the rope is inserted together with the insert and a rear end portion coupled to the boss of the fixing part.

In an embodiment, the insert may have a conical shape in which a rear end has a larger width than a front end.

In an embodiment, the insert may include a plurality of stoppers protruding from an outer circumferential surface thereof and spaced apart from each other at predetermined intervals in a lengthwise direction.

In an embodiment, the coupling part may include a coupling portion coupled to the boss of the fixing part and an accommodating portion protruding forward from the coupling portion and having the insert inserted thereinto, and an inner circumferential surface of the accommodating portion may have a gradually increasing width from a front end toward a rear end.

According to another aspect of the present disclosure, exercise equipment includes the rope fastener set forth in claim 1, a rope having the rope fastener coupled to one end thereof, a housing including a body having a through-hole formed therein through which the rope passes and a button recess formed therein in a vertical position so as to be fluidly connected with the through-hole, a length adjustment button that is installed in an upper portion of the button recess so as to be movable upward and downward and that elastically presses and supports the rope, a support member installed in a lower portion of the button recess and having a connecting hole formed therein through which the rope passes, the connecting hole being fluidly connected with the through-hole, and an elastic member that is installed in a mounting recess of the support member and that elastically supports the length adjustment button, and a handle coupled to one side of the housing.

In an embodiment, the body may include a main block having the through-hole and the button recess formed therein and a pair of auxiliary blocks protruding from opposite sides of the main block.

In an embodiment, the body may include a front protruding portion protruding from a front surface of the main block and having the through-hole extending through the front protruding portion and a rear protruding portion protruding from a rear surface of the main block and having the through-hole extending through the rear protruding portion. A withdrawal recess is formed at a lower end of the rear protruding portion through cutting, and a winding groove is formed on an outer circumferential surface of the rear protruding portion.

In an embodiment, the auxiliary blocks may include a coupling hole to which one end of the handle is coupled and a stopping hole formed below the coupling hole and cut at one side thereof.

According to another aspect of the present disclosure, a frame for an exercise aid includes a pair of frames having an arch shape and spaced apart from each other at a predetermined interval, a bridge that is provided between the pair of frames and that connects the pair of frames, and a protruding portion to which a mounting part on which a part of a user's body is mounted is fastened, the protruding portion being provided on one surface of the bridge.

In an embodiment, the frame may further include a pair of support members that are provided at opposite ends of the pair of frames and that support the ground.

In an embodiment, a first pattern groove having a first shape and fastened to a first region on an outer surface of a support may be formed on an opposite surface of the bridge that faces toward a center point of the arch shape, and a pair of second pattern grooves having a second shape and fastened to a second region on the outer surface of the support may be formed on surfaces of the pair of support members that face toward the center point of the arch shape.

In an embodiment, the first shape and the second shape may be the same as each other.

According to another aspect of the present disclosure, an exercise aid includes a support having a semi-cylindrical shape and including a plurality of arch grooves having an arch shape and formed on an outer surface of the semi-cylindrical shape, a frame for the exercise aid, the frame including a pair of frames that have the arch shape and that are spaced apart from each other at a predetermined interval and fastened to at least two of the plurality of arch grooves, a bridge that is provided between the pair of frames and that connects the pair of frames, and a protruding portion provided on one surface of the bridge, and a mounting part on which a part of a user's body is mounted, the mounting part being fastened to the protruding portion.

In an embodiment, the support may include support grooves formed in opposite end surfaces of the semi-cylindrical shape and extending from center points of the opposite end surfaces of the semi-cylindrical shape in a vertical direction by a predetermined length.

In an embodiment, the mounting part may include a body having a plate shape and including a mounting pattern formed on one surface thereof and a coupling recess formed on an opposite surface of the body and coupled with the protruding portion.

In an embodiment, the mounting part may be a protrusion having a shape in which one surface protrudes and including, on an opposite surface thereof, a coupling recess coupled with the protruding portion.

In an embodiment, the frame for the exercise aid may further include a pair of support members that are provided at opposite ends of the pair of frames and that support the ground.

In an embodiment, a first pattern groove having a first shape and fastened to a first region on an outer surface of the support may be formed on an opposite surface of the bridge that faces toward a center point of the arch shape, and a pair of second pattern grooves having a second shape and fastened to a second region on the outer surface of the support may be formed on surfaces of the pair of support members that face toward the center point of the arch shape.

Advantageous Effects of the Invention

According to the various embodiments of the present disclosure, the following effects are achieved.

According to the various embodiments of the present disclosure, the rope fastener enables an elastic rope to be firmly fastened to one side of exercise equipment.

Furthermore, the exercise equipment enables a user to easily follow Pilates and home training motions at home using a simple structure.

In addition, the frame for the exercise aid and the exercise aid including the same enable a user to conveniently mount various body parts, such as the back, the waist, the calf, and the like, when doing exercises such as yoga, Pilates, home training, and the like.

Effects of the present disclosure are not limited to the aforementioned effects, and any other effects not mentioned herein will be clearly understood from the following description by those skilled in the art to which the present disclosure pertains.

DESCRIPTION OF THE DRAWINGS

The accompanying drawings, which are included to provide a further understanding of the present disclosure, provide various embodiments of the present disclosure together with the detailed description. Technical features of the various embodiments of the present disclosure are not limited to specific drawings. Features disclosed in the respective drawings may be combined together to configure a new embodiment. Reference numerals in each drawing mean structural elements.

BEST MODE

Figure 1:
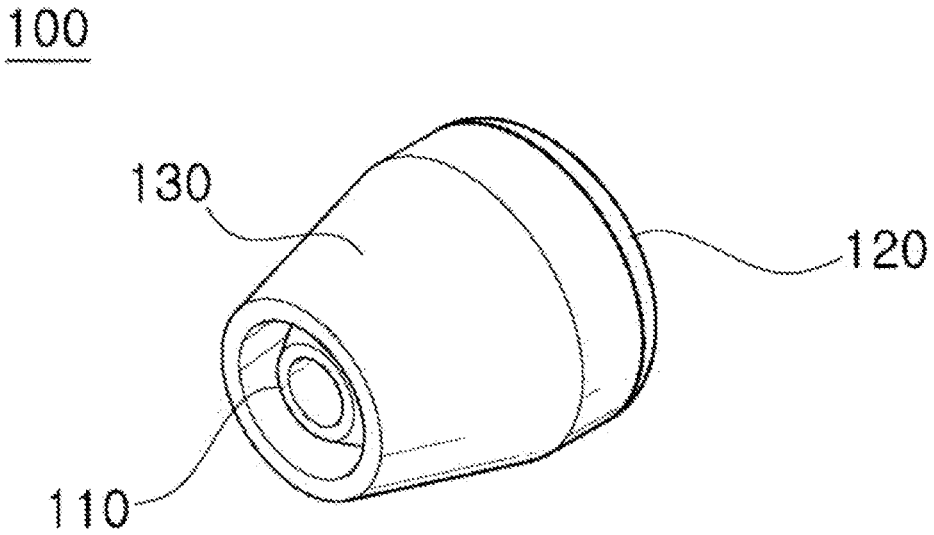
FIG. 1 is a perspective view of a rope fastener according to an embodiment of the present disclosure.

Reference will now be made in detail to the exemplary implementations of the present disclosure, examples of which are illustrated in the accompanying drawings. The detailed description, which will be given below with reference to the accompanying drawings, is intended to explain exemplary implementations of the present disclosure, rather than to show the only implementations that can be implemented according to the present disclosure. The following detailed description includes specific details in order to provide a thorough understanding of the present disclosure. However, it will be apparent to those skilled in the art that the present disclosure may be practiced without such specific details.

In some cases, to avoid obscuring the concept of the present disclosure, well-known structures and devices may be omitted or represented as block diagrams centering on the core functions of the structures and devices. In addition, the same reference numbers will be used throughout the drawings to refer to the same or like parts in this specification.

While the embodiments of the present disclosure are susceptible to various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is to cover all modifications, equivalents, and alternatives falling within the spirit and scope of the present disclosure.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

In various embodiments of the present disclosure, "/" and "," should be construed as indicating "and/or". For example, "A/B" may mean "A and/or B". In addition, "A, B" may mean "A and/or B". In addition, "AB/C" may mean "at least one of A, B, and/or C". In addition, "A, B, C" may mean "at least one of A, B, and/or C".

In various embodiments of the present disclosure, "or" should be construed as indicating "and/or". For example, "A or B" may include "only A", "only B", and/or "both A and B". In other words, "or" should be construed as indicating "additionally or alternatively".

Terms used herein are for the purpose of describing particular embodiments only and are not intended to limit the present disclosure. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application. Hereinafter, various embodiments of the present disclosure will be described in detail with reference to the accompanying drawings.

Exercise Equipment

Figure 2:
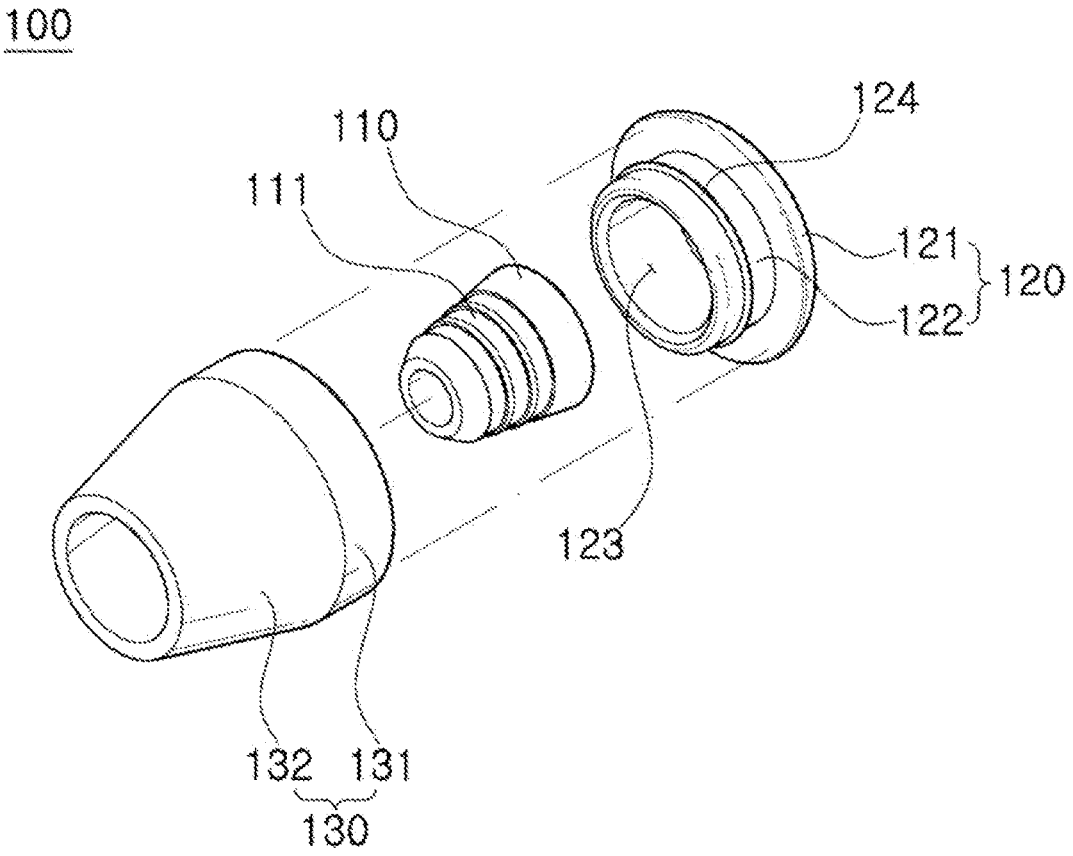
FIG. 2 is an exploded perspective view of FIG. 1.

FIG. 1 is a perspective view of a rope fastener according to an embodiment of the present disclosure, and FIG. 2 is an exploded perspective view of FIG. 1.

The rope fastener 100 according to the embodiment of the present disclosure serves to firmly fix a rope fastened to one side of a product or structure, such as exercise equipment, to prevent unexpected release of the rope. Hereinafter, a configuration thereof will be described in detail with reference to FIGS. 1 and 2.

As illustrated in FIGS. 1 and 2, the rope fastener 100 according to the embodiment of the present disclosure includes an insert 110 inserted into a hollow of a rope 10 (refer to FIG. 3) in an elastic tubular form, a fixing part 120 that is disposed behind the insert 110 and into which an end of the rope 10 is inserted, and a coupling part 130 into which the insert 110 is inserted together with the rope 10 and that is coupled with the fixing part 120.

The rope 10 in an elastic tubular form has the hollow therein, and the insert 110 is inserted into the hollow in the end of the rope 10. The insert 110 is formed in a conical shape, in which the width of the front end is smaller than the width of the rear end, so as to be easily inserted into the hollow of the rope 10, and the outer diameter of the insert 110 is larger than the inner diameter of the hollow of the rope 10 so that the outer diameter of the rope 10 formed of an elastic material is expanded by the insert 110.

Furthermore, the insert 110 has a plurality of stoppers 111 protruding from the outer circumferential surface thereof and spaced apart from each other at predetermined intervals in the lengthwise direction, and the stoppers 111 serve to prevent a slip of the rope 10 sandwiched between the insert 110 and the coupling part 130 to be described below.

The fixing part 120 includes a base 121 having a predetermined thickness and a boss 122 protruding forward from the center of the front surface of the base 121 and having an insert recess 123.

The rear end of the insert 110 inserted into the rope 10 through the hollow in the end of the rope 10 is spaced apart forward from the end of the rope 10 at a predetermined interval, and the end portion of the rope 10 extends behind the insert 110 accordingly. The fixing part 120 accommodates, in the insert recess 123 of the boss 122, the end portion of the rope 10 and is coupled with the coupling part 130, which will be described below, to serve to integrally support the rope 10, the insert 110, and the coupling part 130.

The coupling part 130 has a hollow through which the rope 10 having the insert 110 inserted thereinto passes and is coupled to the front surface of the fixing part 120. The coupling part 130 may include a coupling portion 131 coupled to the boss 122 of the fixing part 120 and an accommodating portion 132 that protrudes forward from the coupling portion 131 and in which the insert 110 is accommodated. The inner circumferential surface of the accommodating portion 132 is formed in a shape in which the width is gradually increased from the front end toward the rear end. The coupling portion 131 of the coupling part 130 and the boss 122 of the fixing part 120 are detachably coupled and for example, may be coupled by a screw coupling method. To this end, a screw protrusion 124 may be formed on the outer circumferential surface of the boss 122, and a screw groove 133 may be formed on the inner circumferential surface of the coupling portion 131.

Figure 3:
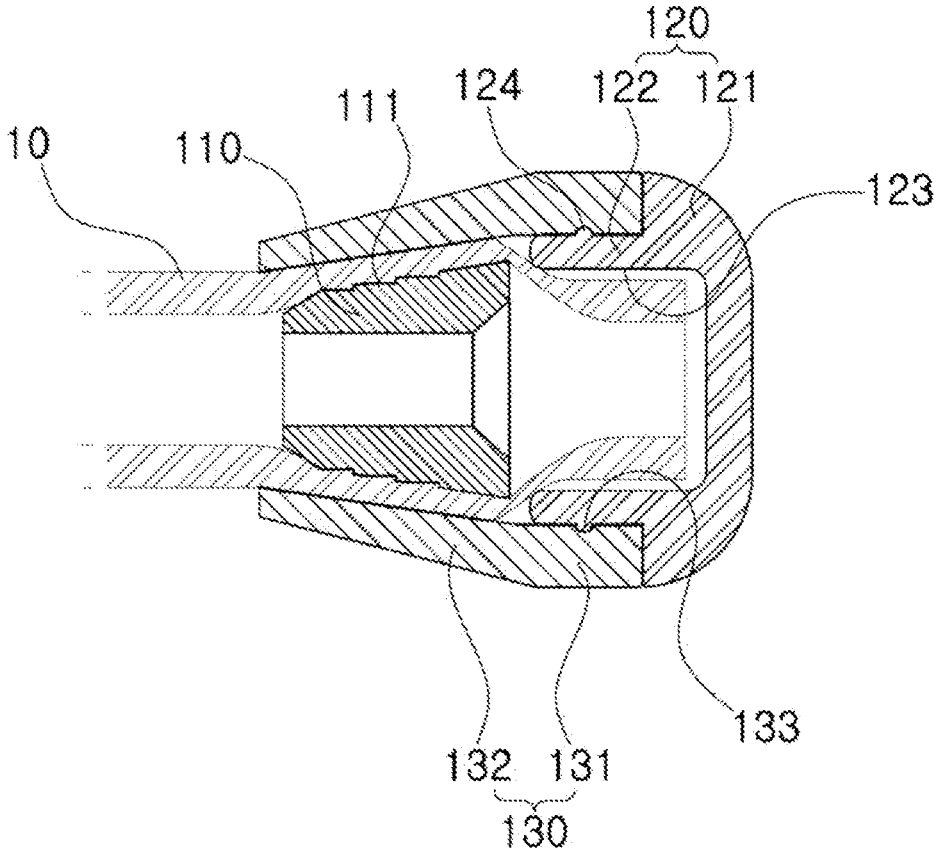
FIG. 3 is an assembled sectional view of FIG. 1.

FIG. 3 is an assembled sectional view of FIG. 1. Hereinafter, an assembly method of the rope fastener according to an embodiment of the present disclosure will be described in detail with reference to FIG. 3.

First, the rope 10 is inserted into the coupling part 130 to pass through the hollow of the coupling part 130. At this time, the end of the rope 10 passes through the coupling part 130 and extends behind the coupling part 130 by a predetermined length.

Next, the insert 110 is inserted into the rope 10 in an elastic tubular form. The insert 110 is inserted into the rope 10 through the hollow in the end of the rope 10. The insert 110 may be inserted such that the rear end of the insert 110 is spaced apart forward from the end of the rope 10 at a predetermined interval.

Then, the fixing part 120 is disposed behind the insert 110. The end of the rope 10 extending behind the insert 110 is inserted into the insert recess 123 of the boss 122 of the fixing part 120, and the rear end of the coupling part 130 is coupled to the front end of the fixing part 120. For example, the coupling part 130 may be screw-coupled to the boss 122 of the fixing part 120.

According to the rope fastener 100 assembled as described above, as illustrated in FIG. 3, the outside of the rope 10 is pressed and supported toward the inner circumferential surface of the coupling part 130 by the insert 110. At this time, the rope 10 is fixedly sandwiched and fixed between the insert 110 and the coupling part 130. Accordingly, even when a predetermined force is applied to pull the rope 10, the rope 10 is not separated from the rope fastener 100, and a user may firmly couple the rope fastener 100 to one side of exercise equipment.

Figure 4:
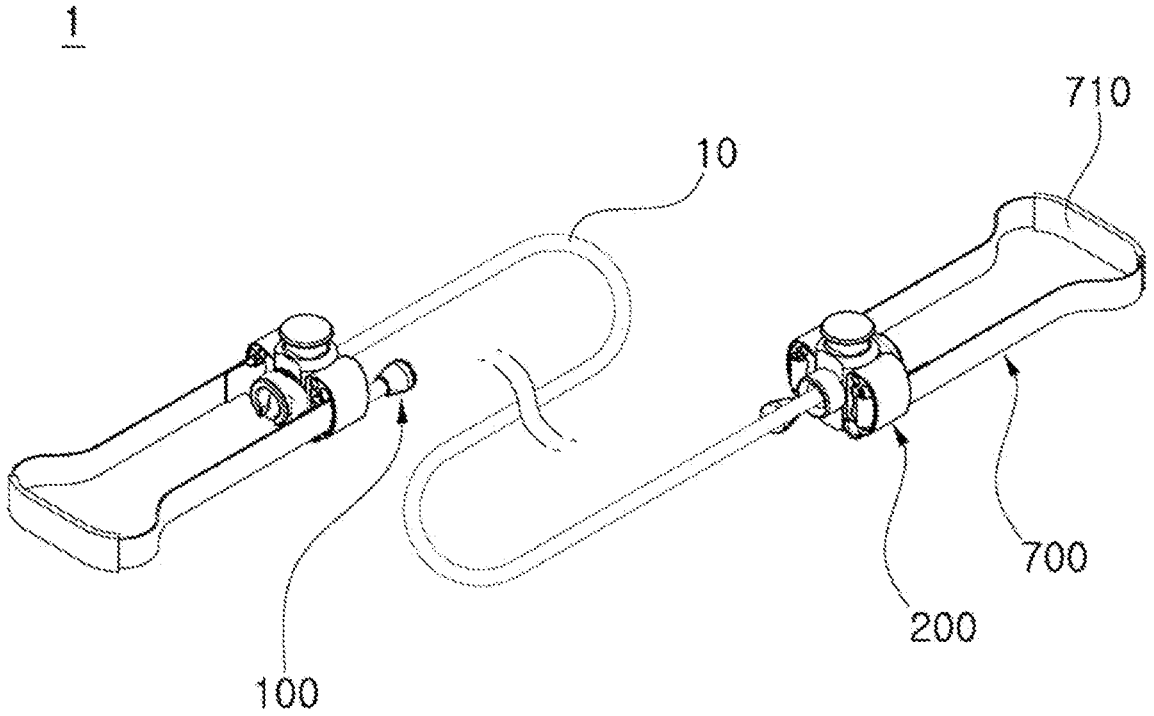
FIG. 4 is a perspective view of exercise equipment according to an embodiment of the present disclosure.

FIG. 4 is a perspective view of exercise equipment having the above-described rope fastener applied thereto according to an embodiment of the present disclosure.

As illustrated in FIG. 4, the exercise equipment 1 according to the embodiment of the present disclosure includes the rope 10 formed of an elastic material, the rope fastener 100 coupled to one end of the rope 10, a housing 200 provided on one side of the rope 10 to adjust the length of the rope 10, and a handle 700 coupled to one side of the housing 200.

The exercise equipment 1 according to the embodiment of the present disclosure is used to perform exercise, such as Pilates, yoga, stretching, or the like, using the elasticity of the rope 10. The user may repeat a motion of stretching the rope 10 with the user's hand or foot inserted into the handle 700.

Figure 5:
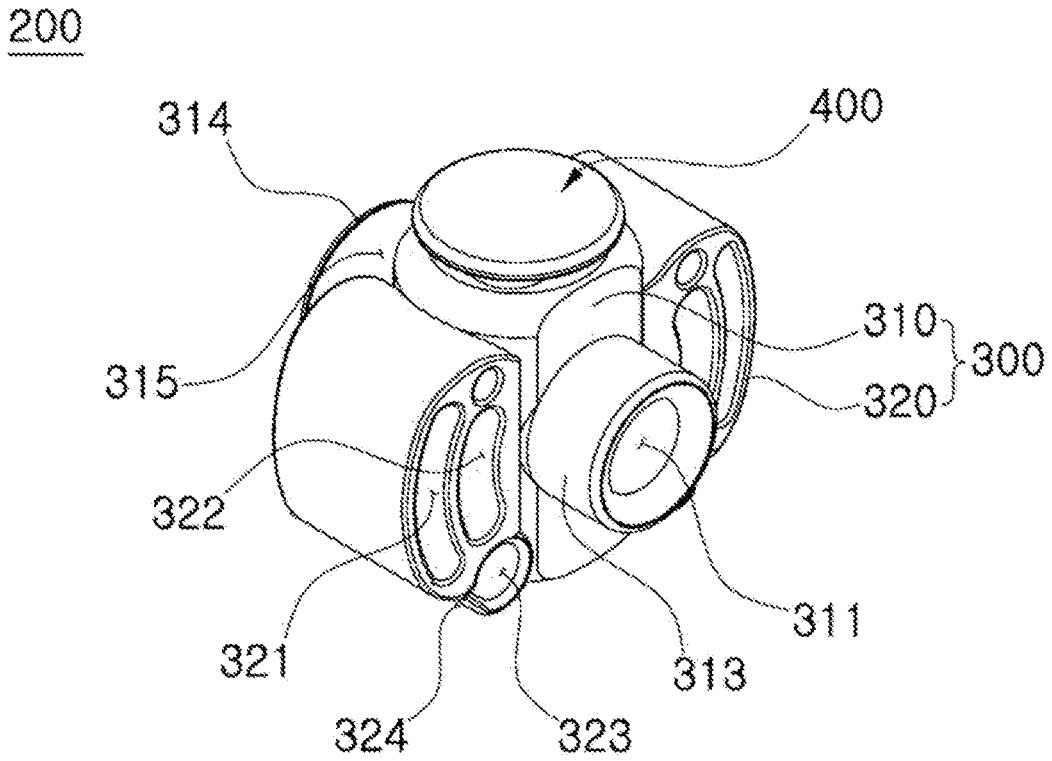
FIGS. 5 and 6 are perspective views of a housing according to an embodiment of the present disclosure.
Figure 6:
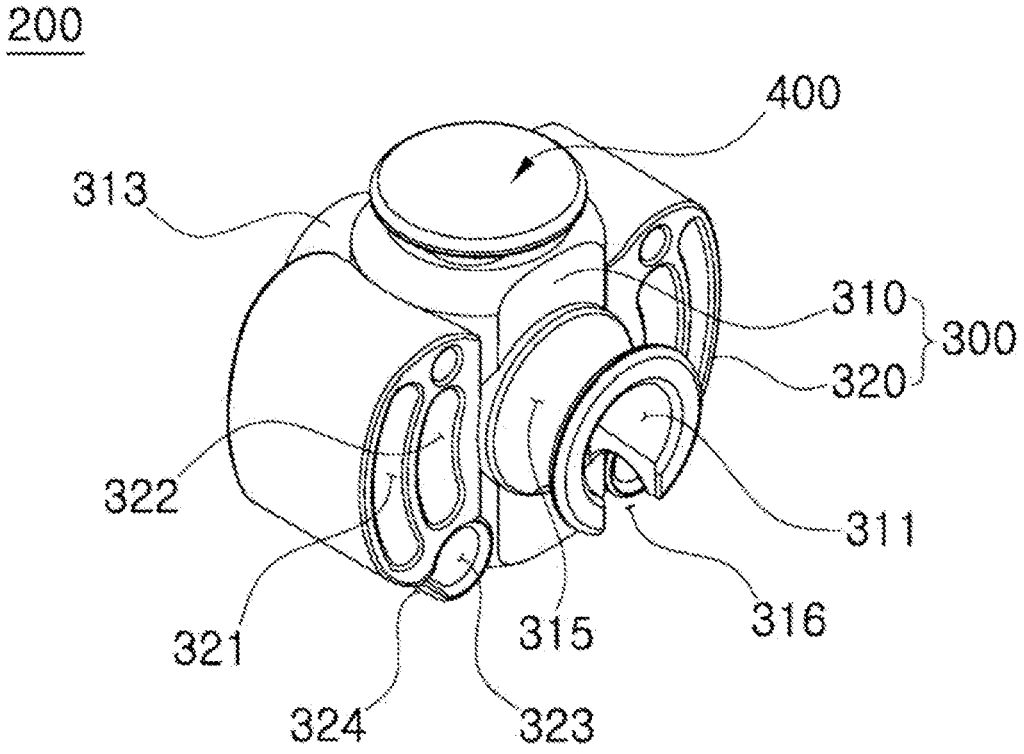
Figure 7:
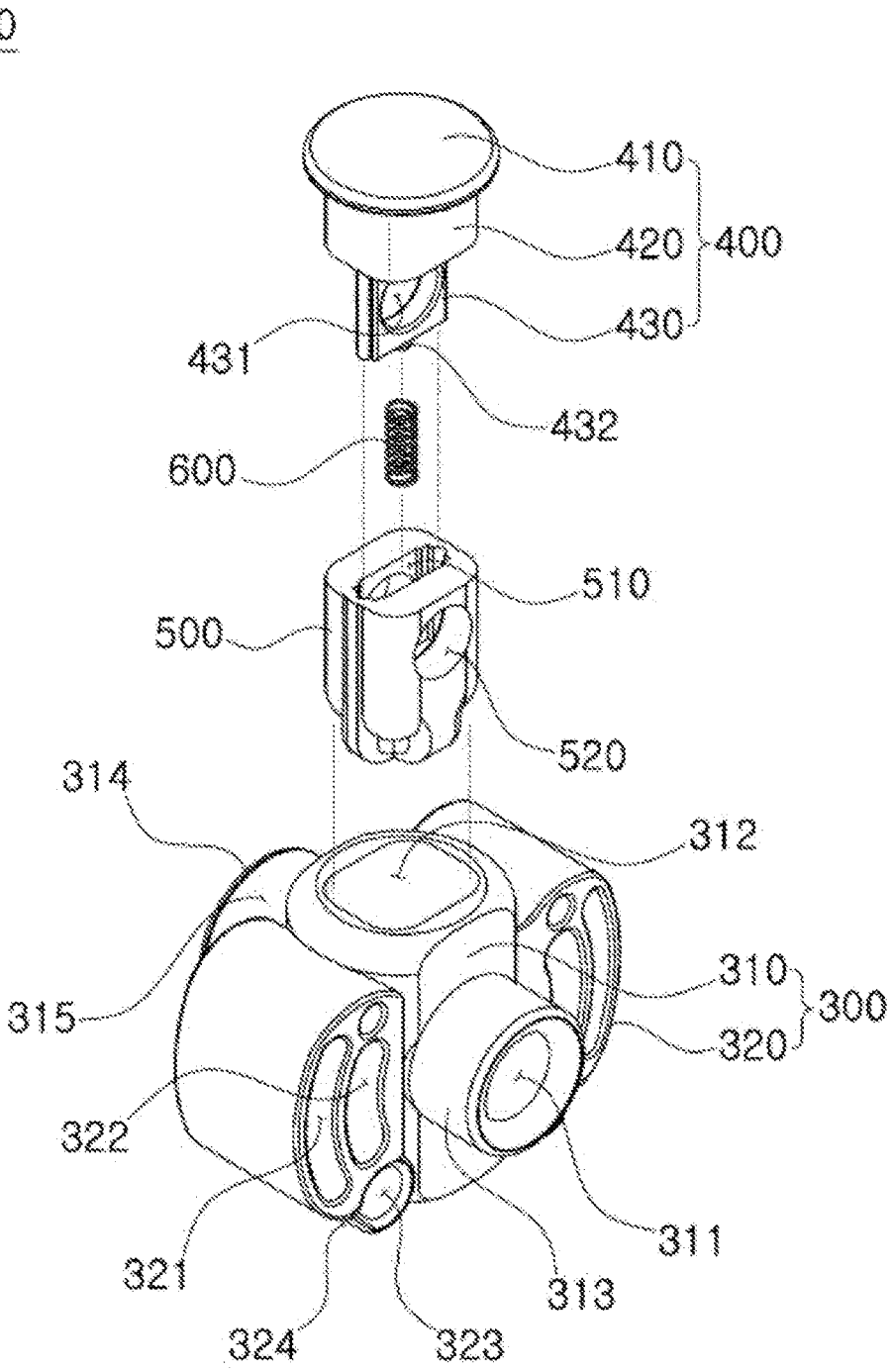
FIG. 7 is an exploded perspective view of the housing according to an embodiment of the present disclosure.

FIGS. 5 and 6 are perspective views of the housing according to an embodiment of the present disclosure, and FIG. 7 is an exploded perspective view of the housing according to an embodiment of the present disclosure.

As illustrated in FIGS. 5 to 7, the housing 200 includes a body 300 through which the rope 10 passes forward and rearward, a length adjustment button 400 and a support member 500 vertically inserted into the body 300, and an elastic member 600 installed in the support member 500 to elastically support the length adjustment button 400.

The body 300 includes a main block 310 in a block form and a pair of auxiliary blocks 320 protruding from opposite sides of the main block 310. A through-hole 311 through which the rope is inserted extends through the main block 310 forward and rearward, and a button recess 312 is vertically formed in the upper side surface of the main block 310 so as to be fluidly connected with the through-hole 311. The length adjustment button 400 to be described below is mounted in the button recess 312, and the inner circumferential surface of the button recess 312 may have a polygonal cross-sectional shape, such as a quadrilateral shape, to prevent rotation of the length adjustment button 400.

Furthermore, a front protruding portion 313 protrudes from the front surface of the main block 310 to surround the through-hole 311, and a rear protruding portion 314 protrudes from the rear surface of the main block 310 to surround the through-hole 311. The front protruding portion 313 and the rear protruding portion 314 guide the insertion direction of the rope 10.

The inner circumferential surface of the rear protruding portion 314 is obliquely formed to correspond to the outer circumferential surface of the coupling part 130 of the above-described rope fastener 100, and a winding groove 315 is formed such that the rope is wound around the outer circumferential surface of the rear protruding portion 314. Furthermore, a withdrawal recess 316 is formed at a lower end of the rear protruding portion 314 through cutting such that the rope 10 is withdrawn outside the rear protruding portion 314.

The auxiliary blocks 320 are formed on the opposite sides of the main block 310, respectively, and a pair of rectangular oval coupling holes curved with a predetermined curvature are formed through each of the auxiliary blocks 320 such that one end of the handle 700 to be described below is coupled to the auxiliary block 320. For example, as illustrated in the drawings, a first coupling hole 321 and a second coupling hole 322 may be formed side by side through the auxiliary block 320, the outer surface of which is formed to be a convex curved surface. The second coupling hole 322 is formed inward of the first coupling hole 321 and has a smaller width than the first coupling hole 321. Furthermore, a stopping hole 323 is formed in a lower end of the auxiliary block 320, an opening 324 is formed on one side of the stopping hole 323 through cutting such that the rope is inserted, and the inner circumferential surface of the rear end of the stopping hole 323 is obliquely formed to correspond to the outer circumferential surface of the coupling part 130 of the rope fastener 100.

Figure 8:
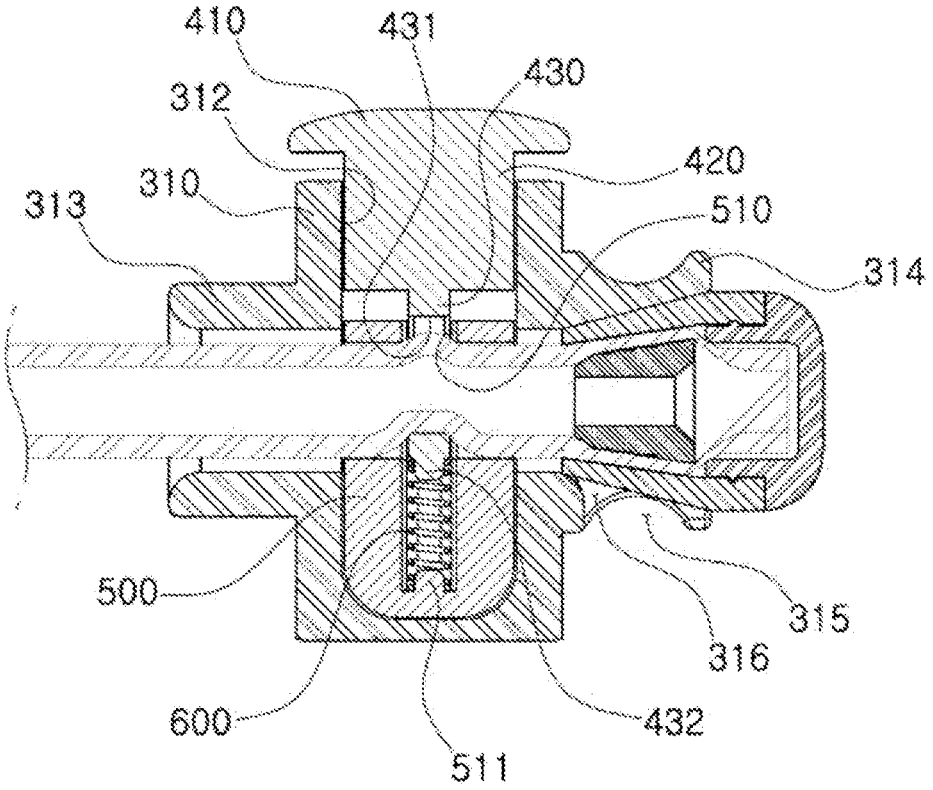
FIG. 8 is an assembled sectional view of the rope fastener and the housing according to an embodiment of the present disclosure.

FIG. 8 is an assembled sectional view of the rope fastener and the housing according to an embodiment of the present disclosure.

Referring to FIGS. 7 and 8, the length adjustment button 400 is installed in an upper portion of the button recess 312 of the main block 310 so as to be movable upward and downward, and the support member 500, into which the lower end of the length adjustment button 400 is inserted, is installed in a lower portion of the button recess 312.

The length adjustment button 400 serves to prevent release of the rope 10 by elastically pressing and supporting the rope 10 when adjusting the length of the rope 10, and the elastic member 600, such as a coil spring, is provided in the support member 500 to elastically support the length adjustment button 400.

The length adjustment button 400 includes a circular head 410, an extension 420 having the same cross-sectional shape as the button recess 312 so as to be coupled to the button recess 312 of the above-described body 300 and extending downward from the head 410, and an insert 430 protruding downward in a plate form from the lower end of the extension 420. An insertion hole 431 through which the rope 10 passes is formed through the insert 430, and a first support protrusion 432 protrudes from the lower end of the insert 430 and is inserted into the coil spring.

The support member 500 has a block form with a space formed therein and is inserted into the lower portion of the button recess 312. To prevent rotation of the support member 500, the outside surface of the support member 500 may be formed in a polygonal shape corresponding to the inner circumferential surface of the button recess 312. A mounting recess 510 into which the insert 430 of the length adjustment button 400 is inserted is formed in the upper side surface of the support member 500, and a connecting hole 520 is formed through the outside surface of the support member 500 so as to be fluidly connected with the mounting recess 510 and the through-hole 311 of the body 300. That is, the rope 10 inserted into the hollow of the body 300 passes through the connecting hole 520 of the support member 500 and the insertion hole 431 of the length adjustment button 400.

Furthermore, a second support protrusion 511 for mounting the coil spring protrudes from the bottom of the mounting recess 510. That is, the coil spring, which is the elastic member 600, is interposed between the first support protrusion 432 of the length adjustment button 400 and the second support protrusion 511 of the support member 500 and elastically supports the length adjustment button 400.

Referring to FIG. 8, the length adjustment button 400 is elastically supported upward by the elastic member 600. At this time, the insertion hole 431 of the insert 430 of the length adjustment button 400 and the connecting hole 520 of the support member 500 are vertically misaligned with each other so that one side of the rope 10 is stopped and supported by the insertion hole 431 of the insert 430. When the user presses the length adjustment button 400 such that the insertion hole 431 of the insert 430 and the connecting hole 520 of the support member 500 are placed side by side on the same axis, the user may shorten the rope 10 by pulling the rope 10 rearward with respect to the housing 200 (to the right side in the drawing).

FIG. 8 illustrates the case where the length of the rope 10 is adjusted to be longest. At this time, the coupling part 130 of the rope fastener 100 is inserted into and supported by the rear protruding portion 314. The user may shorten the rope 10 connected between a pair of housings 200, by pressing the length adjustment button 400 and thereafter pulling the rope 10 rearward with respect to the housing 200.

For example, FIG. 4 illustrates an example that the entire length of the rope 10 is reduced by extracting the rope 10 extending behind the housing 200 through the withdrawal recess 316 at the lower end of the rear protruding portion 314, winding the rope 10 around the winding groove 315 on the outer circumferential surface of the rear protruding portion 314, inserting the rope 10 into the stopping hole 323 in the lower end of the auxiliary block 320, and firmly supporting the rope fastener 100 on the rear end of the stopping hole 323. The length of the rope 10 between the pair of housings 200 is made shorter with an increase in the number of times that the rope 10 is wound around the winding groove 325 of the rear protruding portion 314.

The handle 700 may be formed of a rigid material such as metal or plastic. The handle 700 is formed in a "U" shape in which a pair of open ends extends side by side from opposite sides of a closed end. Furthermore, the handle 700 is coupled to the body 300 by passing the open ends through the first coupling holes 321 from behind the auxiliary blocks 320, bending the open ends, and inserting the open ends into the second coupling hole 322 from ahead of the auxiliary blocks 320. A grip part 710 having an increased width is formed on the closed end to enable the user to easily grip the handle 700.

Figure 9:
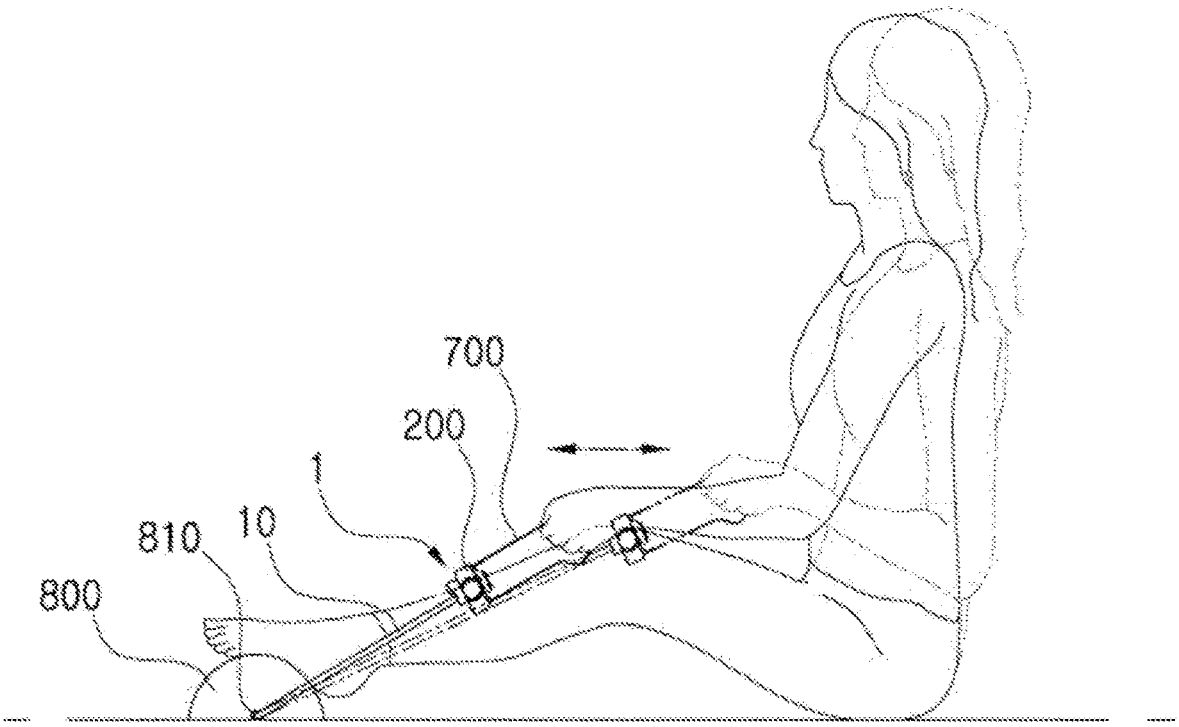
FIGS. 9 and 10 are views illustrating states in which the exercise equipment according to the embodiment of the present disclosure is used.
Figure 10:
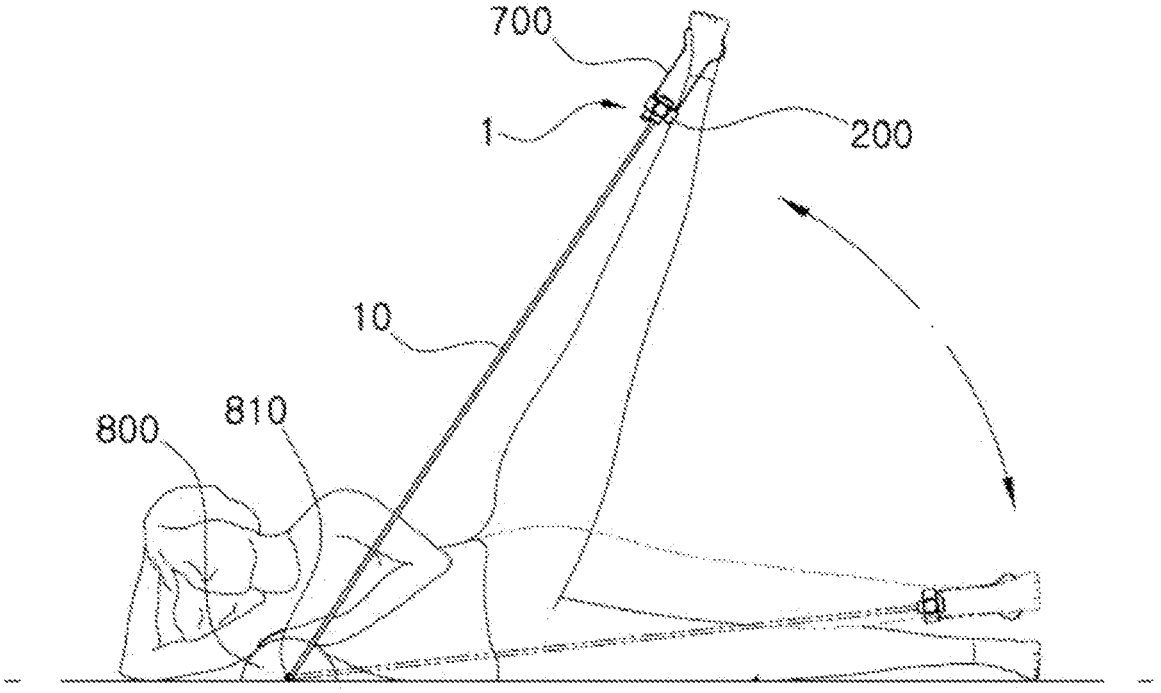

FIGS. 9 and 10 are views illustrating states in which the exercise equipment according to the embodiment of the present disclosure is used.

For example, the user may hang the central portion of the rope 10 on the foot and may do exercise while pulling both handles 700. FIG. 9 illustrates an example that the central portion of the rope 10 is supported by a separate support 800 through which the rope 10 passes. The support 800 may be formed of metal, wood, rubber, or plastic and may have a semicircular cross-sectional shape, and a support groove 810 into which the rope 10 is inserted may be formed on the flat bottom surface of the support 800. Detailed description of the support 800 will be given below.

FIG. 10 illustrates an example that the user does exercise with the foot inserted into one handle 700. At this time, the opposite handle 700 is stopped and supported by the support 800.

Meanwhile, the embodiments illustrated in FIGS. 9 and 10 show some of various uses of the exercise equipment 1, and it should be understood that the exercise equipment 1 according to the embodiment of the present disclosure can be used in various forms and operations as needed.

Exercise Aid

Hereinafter, an exercise aid 2 that can be used independently or together with the exercise equipment 1 will be described in detail.

Figure 11:
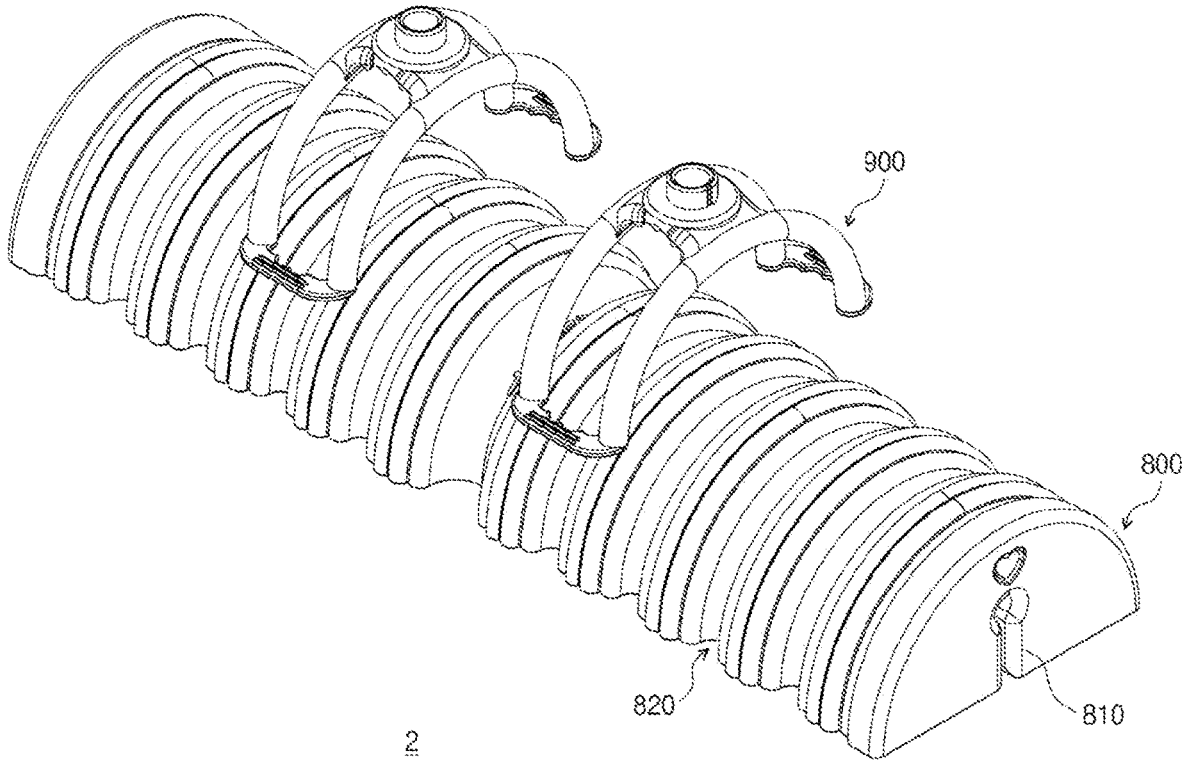
FIG. 11 is a perspective view of an exercise aid according to an embodiment of the present disclosure.
Figure 12:
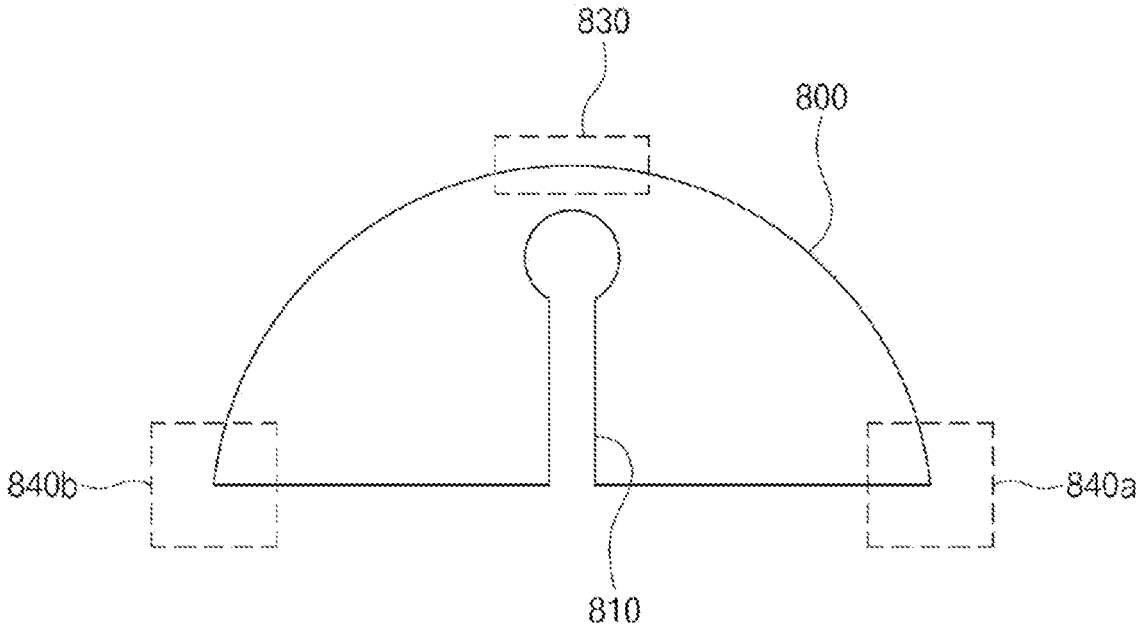
FIG. 12 is a sectional view of a support according to an embodiment of the present disclosure.

FIG. 11 is a perspective view of the exercise aid according to an embodiment of the present disclosure, and FIG. 12 is a sectional view of the support according to an embodiment of the present disclosure.

Referring to FIG. 11, the exercise aid 2 according to the embodiment of the present disclosure includes the support 800 and a frame 900 for the exercise aid.

The support 800 may have various shapes capable of supporting the ground. For example, the support 800 may have a semi-cylindrical shape as illustrated. However, without being limited thereto, the support 800 may have all shapes capable of supporting the ground.

Referring to FIG. 12, when the support 800 has, for example, a semi-cylindrical shape, the support 800 may include support grooves 810 provided in opposite end surfaces of the semi-cylindrical shape. Here, the opposite end surfaces of the semi-cylindrical shape may refer to the upper surface and/or the lower surface rather than the column surface of the semi-cylinder.

The support grooves 810 may be vertically formed from the center points of the opposite end surfaces of the semi-cylindrical shape by a predetermined length. As described above, the rope 10 of the exercise equipment 1 may be inserted into the support grooves 810.

For example, when the support 800 has a semi-cylindrical shape, a plurality of arch grooves 820 having an arch shape may be formed on the outer surface of the semi-cylindrical shape of the support 800, that is, the column surface thereof. The plurality of arch grooves 820 may be provided at predetermined intervals along the lengthwise direction of the column surface of the semi-cylindrical shape and may have the same size, or at least two arch grooves may have a different size. Alternatively, the plurality of arch grooves 820 may be spaced apart from each other at predetermined intervals on the outer surface of the semi-cylindrical shape, and the predetermined intervals between the plurality of arch grooves 820 may be the same as, or different from, one another. The frame 900 for the exercise aid is fastened to the arch grooves 820.

The support 800 may include a first region 830 and second regions 840*a* and 840*b*. The first region 830 is a region to which a first pattern groove 921 of the frame 900 for the exercise aid to be described below is fastened. For example, when the support 800 has a semi-cylindrical shape, the region having a predetermined area with respect to the apex in the cross-section of the column surface of the semi-cylindrical shape may be the first region 830.

The second regions 840*a* and 840*b* are regions to which second pattern grooves 941*a* and 941*b* of the frame 900 for the exercise aid to be described below are fastened. For example, when the support 800 has a semi-cylindrical shape, the regions having a predetermined area with respect to the opposite ends in the cross-section of the column surface of the semi-cylindrical shape may be the second regions 840*a* and 840*b*.

The frame 900 for the exercise aid may be fastened to the outer surface of the support 800, that is, the column surface thereof and may be fastened to, for example, the arch grooves 820 formed on the column surface of the support 800. A plurality of frames 900 for the exercise aid may be provided.

Hereinafter, the frame 900 for the exercise aid will be described in detail.

Figure 13:
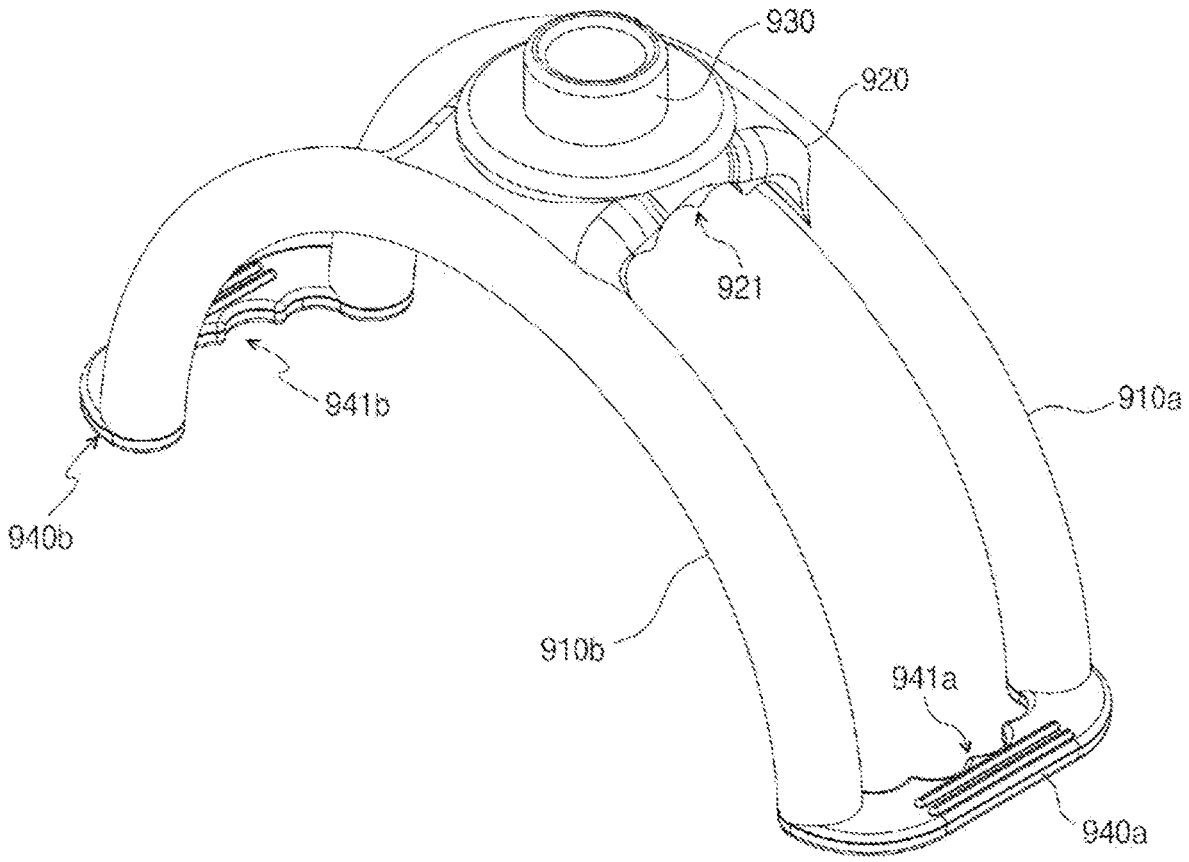
FIG. 13 is a perspective view of a frame for the exercise aid according to an embodiment of the present disclosure.
Figure 14:
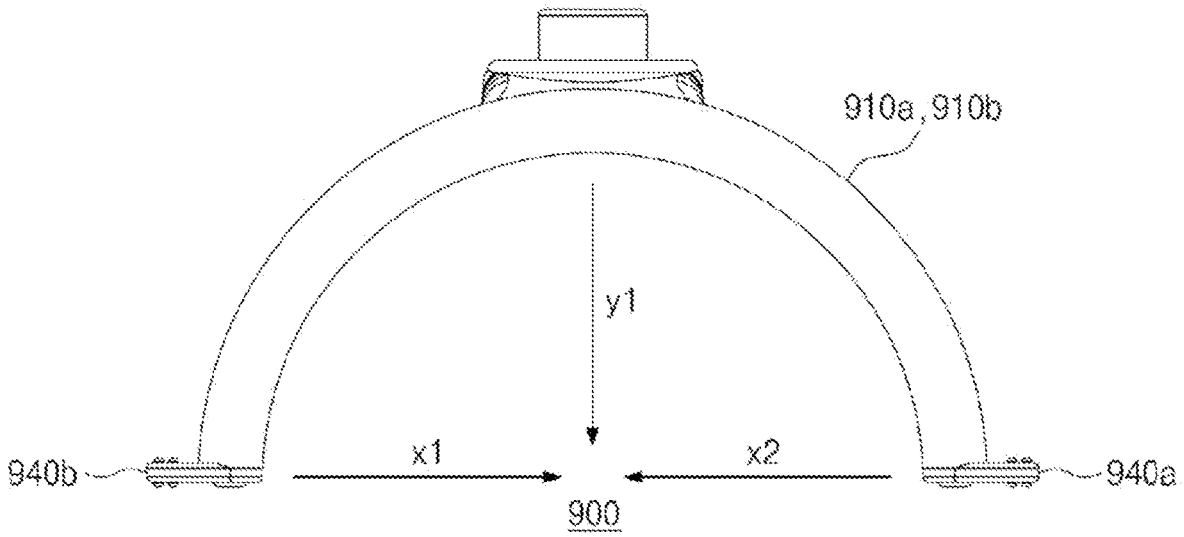
FIG. 14 is a side view of the frame for the exercise aid according to an embodiment of the present disclosure.
Figure 15:
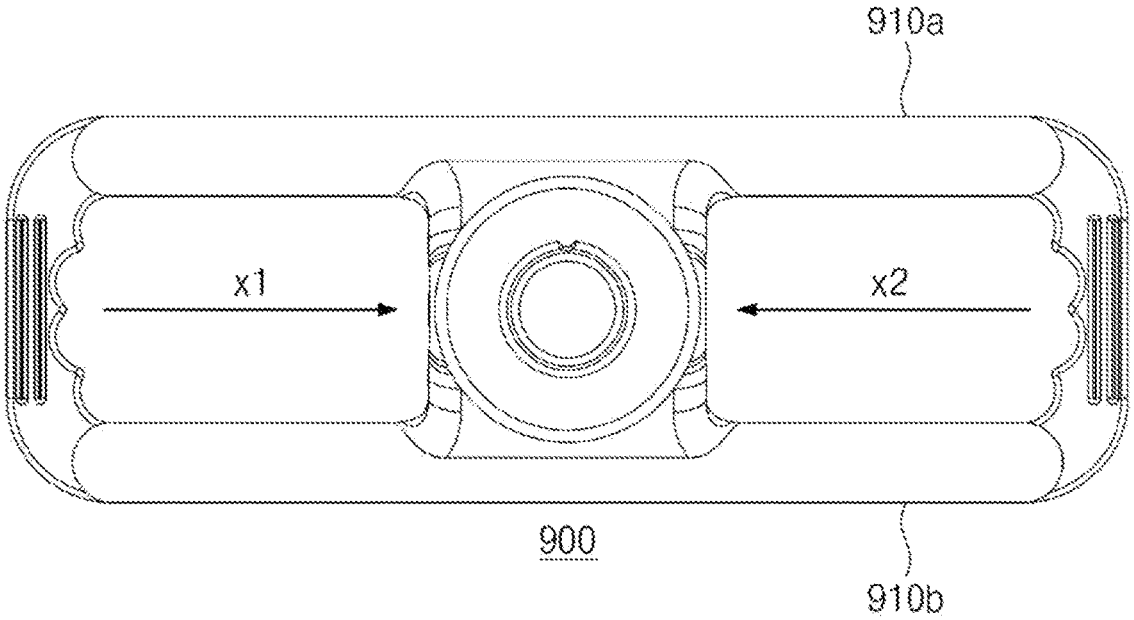
FIG. 15 is a plan view of the frame for the exercise aid according to an embodiment of the present disclosure.

FIG. 13 is a perspective view of the frame for the exercise aid according to an embodiment of the present disclosure, FIG. 14 is a side view of the frame for the exercise aid according to an embodiment of the present disclosure, and FIG. 15 is a plan view of the frame for the exercise aid according to an embodiment of the present disclosure.

Referring to FIGS. 13 to 15, the frame 900 for the exercise aid according to the embodiment of the present disclosure includes a pair of frames 910*a* and 910*b*, a bridge 920, a protruding portion 930, and a pair of support members 940*a* and 940*b*.

The pair of frames 910*a* and 910*b* may have, for example, an arch shape and may be spaced apart from each other at a predetermined interval. The pair of frames 910*a* and 910*b* may have an arch shape corresponding to the arch grooves 820 so as to be fastened to the arch grooves 820 formed on the column surface of the above-described support 800.

The bridge 920 is provided between the pair of frames 910*a* and 910*b* and connects the pair of frames 910*a* and 910*b*. For example, when the pair of frames 910*a* and 910*b* have an arch shape, the bridge 920 may be provided at the position corresponding to the apex of the arch shape. That is, when the pair of frames 910*a* and 910*b* are connected by the bridge 920, the pair of frames 910*a* and 910*b* and the bridge 920 may have an "H" shape in a plan view.

The protruding portion 930 may be provided on one surface of the bridge 920. Furthermore, the first pattern groove 921 may be formed on an opposite surface of the bridge 920. Here, the opposite surface of the bridge 920 may be the surface facing toward (y1) the center point of the arch shape of the pair of frames 910*a* and 910*b*, and the one surface may be the surface facing away from the opposite surface.

The first pattern groove 921 may include a plurality of grooves and may be fastened to the first region 830 of the outer surface of the support 800, that is, the column surface thereof. To this end, the first pattern groove 921 may have a first shape. For example, the first shape may be a shape corresponding to the outer surface of the support 800.

The protruding portion 930 is provided on the one surface of the bridge 920. For example, the protruding portion 930 may have a shape protruding from the one surface of the bridge 920, and a mounting part for mounting a part of the user's body may be fastened to the protruding portion 930. Detailed description of the mounting part will be given below.

Alternatively, unlike that illustrated in the drawings, the protruding portion 930 may have a recess shape corresponding to the mounting part. That is, the protruding portion 930 may have various shapes capable of being coupled with the mounting part in a male-female coupling manner.

The pair of support members 940*a* and 940*b* are provided at opposite ends of the pair of frames 910*a* and 910*b* and support the ground. The pair of second pattern grooves 941*a* and 941*b* may be formed on surfaces of the pair of support members 940*a* and 940*b* that face toward (x1, x2) the center point of the arch shape of the pair of frames 910*a* and 910*b*.

The pair of second pattern grooves 941*a* and 941*b* may include a plurality of grooves and may be fastened to the second regions 840*a* and 840*b* of the outer surface of the support 800, that is, the column surface thereof. To this end, the pair of second pattern grooves 941*a* and 941*b* may have a second shape. For example, the second shape may be a shape corresponding to the outer surface of the support 800. As the pair of second pattern grooves 941*a* and 941*b* have the second shape, the frame 900 for the exercise aid may be appropriately fastened with the support 800 even without a separate fixing means. Accordingly, the user may fasten the frame 900 for the exercise aid to the support 800 without fastening a separate fixing means and may easily separate the frame 900 for the exercise aid without releasing a separate fixing means.

The first shape of the first pattern groove 921 and the second shape of the pair of second pattern grooves 941*a* and 941*b* may be the same as each other. Alternatively, when the shapes of the first region 830 and the second regions 840*a* and 840*b* differ from each other, the first shape and the second shape may differ from each other.

Hereinafter, various embodiments of the mounting part fastened to the protruding portion 930 of the frame 900 for the exercise aid will be described.

For example, the mounting part may be a plate-shaped cradle.

Figure 16:
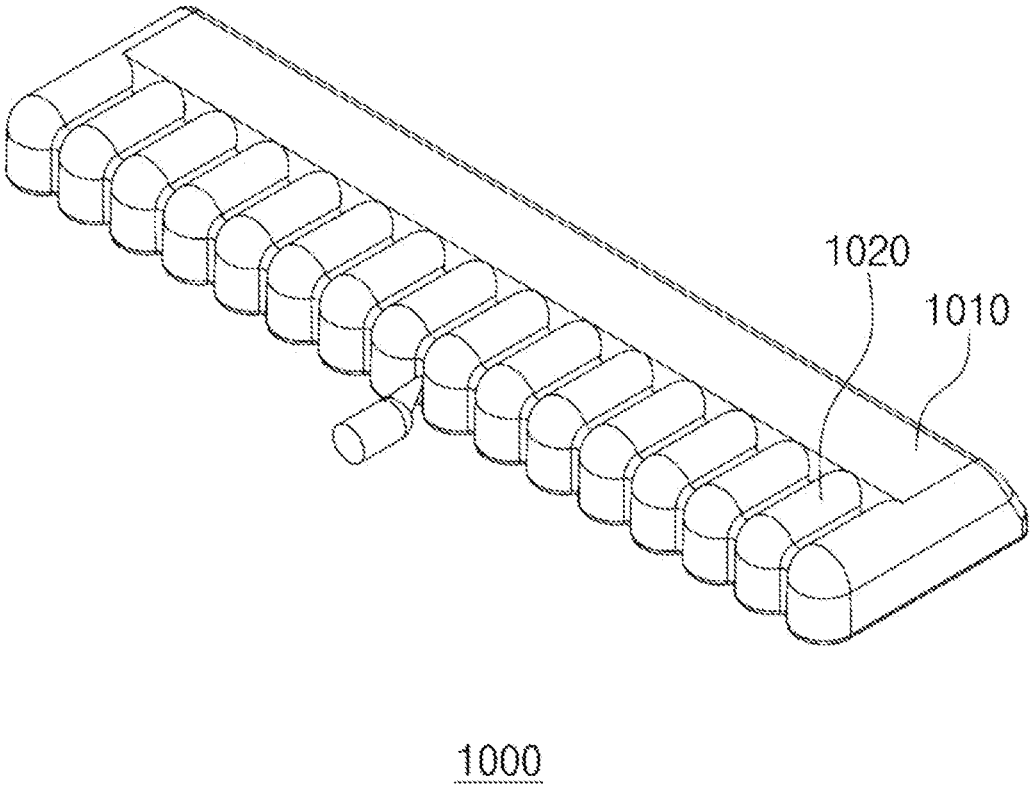
FIG. 16 is a perspective view of a cradle according to an embodiment of the present disclosure.
Figure 17:
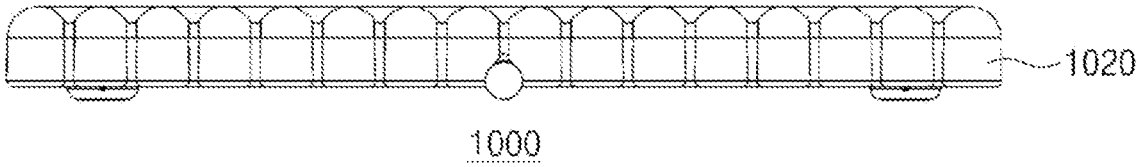
FIG. 17 is a front view of the cradle according to an embodiment of the present disclosure.
Figure 18:
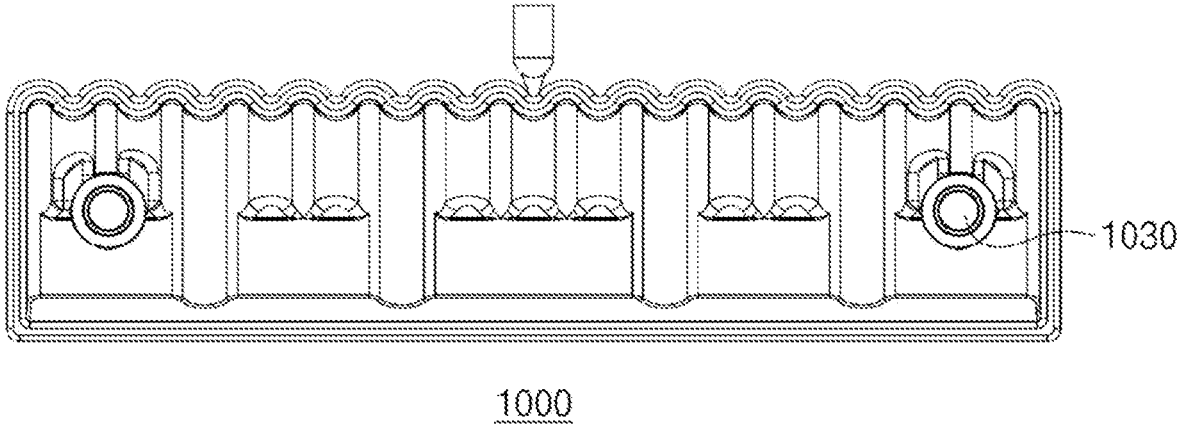
FIG. 18 is a bottom view of the cradle according to an embodiment of the present disclosure.
Figure 19:
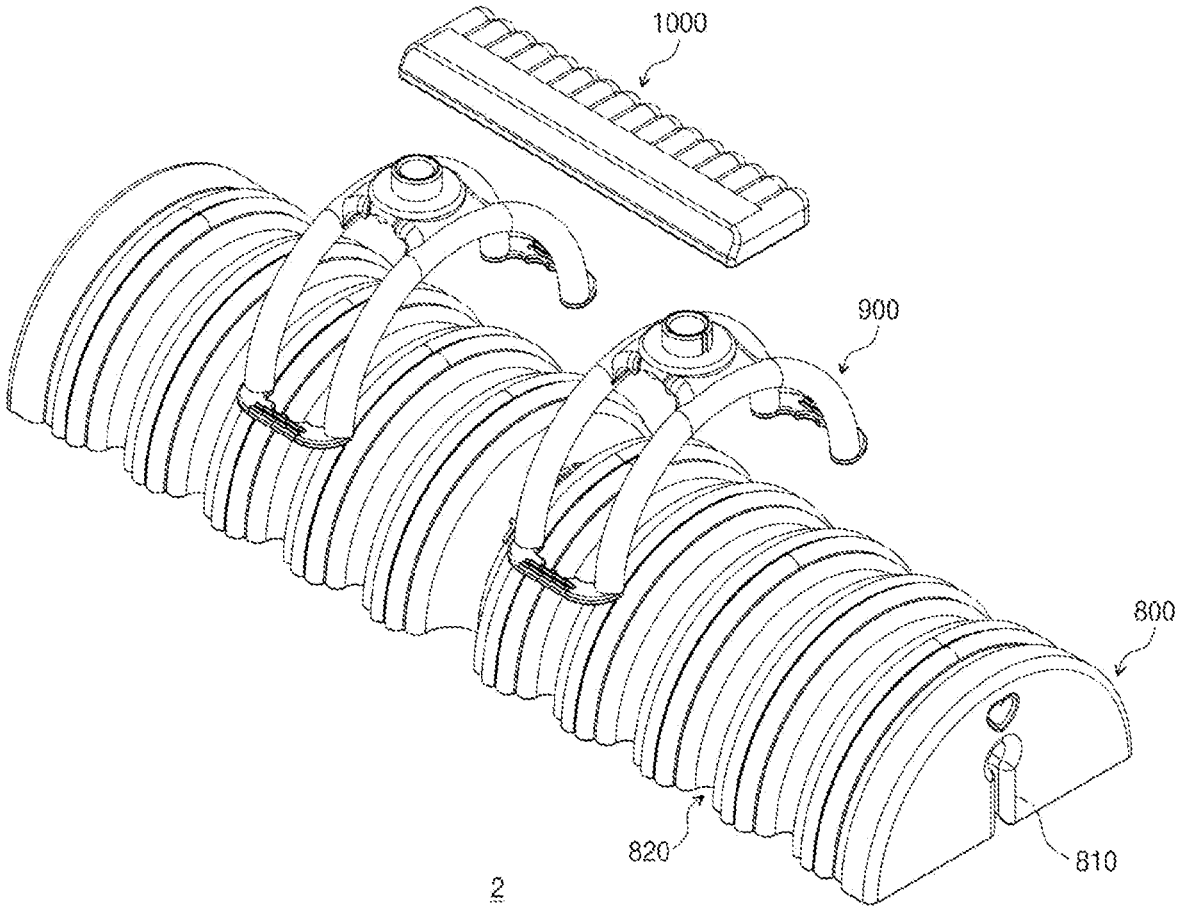
FIG. 19 is a perspective view of the exercise aid having the cradle coupled thereto according to an embodiment of the present disclosure.

FIG. 16 is a perspective view of a cradle according to an embodiment of the present disclosure, FIG. 17 is a front view of the cradle according to an embodiment of the present disclosure, FIG. 18 is a bottom view of the cradle according to an embodiment of the present disclosure, and FIG. 19 is a perspective view of the exercise aid having the cradle coupled thereto according to an embodiment of the present disclosure.

Referring to FIGS. 16 to 19, the cradle 1000 includes a body 1010 and a coupling recess 1030.

Although the body 1010 is illustrated as having a plate shape, that is, a quadrilateral shape, the body 1010 may have various shapes on which the user's calf is mounted. A mounting pattern 1020 is formed on one surface of the body 1010. The mounting pattern 1020 is formed on the body 1010 to prevent a slip of the user's calf when the user mounts the calf on the cradle 1000. For example, the mounting pattern 1020 may have a shape having a plurality of protrusions protruding at predetermined intervals when viewed from the front. However, without being limited thereto, the mounting pattern 1020 may have various shapes to prevent a slip of the user.

The coupling recess 1030 is formed on an opposite surface (e.g., an inner surface) of the body 1010 rather than the one surface of the body 1010 on which the mounting pattern 1020 is formed. One, two or more coupling recesses 1030 may be provided and may be coupled with the protruding portion 930 of the frame 900 for the exercise aid. Furthermore, as described above, the coupling recess 1030 may have various shapes capable of being coupled with the protruding portion 930 in a male-female coupling manner.

Unlike the above-described cradle 1000, the mounting part may be protrusions 1100*a* to 1100*d*.

Figure 20:
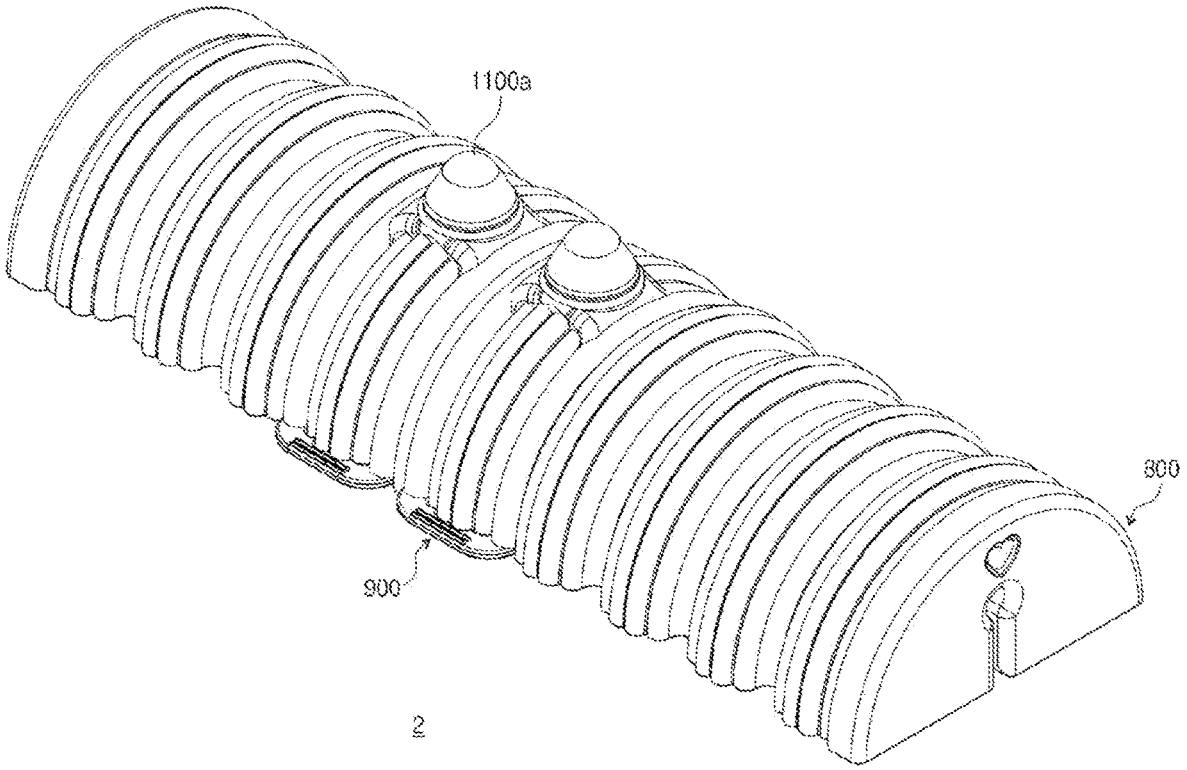
FIGS. 20 and 21 are perspective views of the exercise aid to which protrusions according to various embodiments of the present disclosure are coupled.
Figure 21:
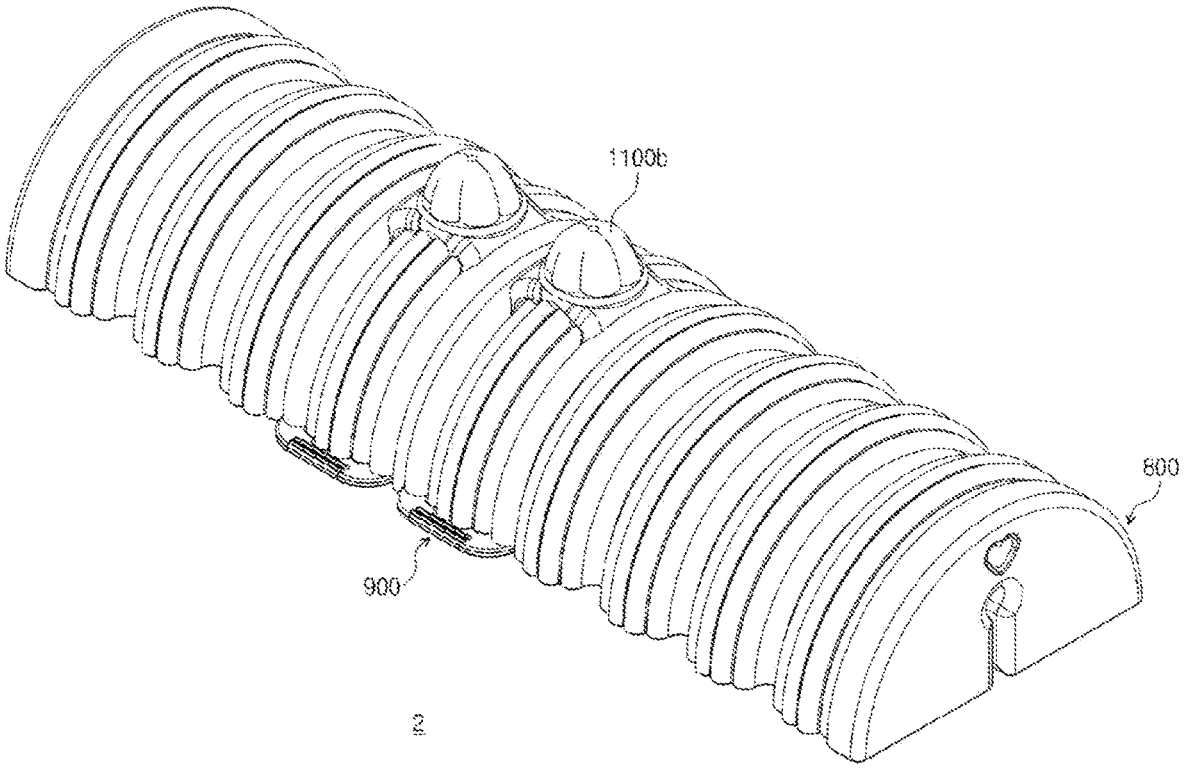

FIGS. 20 and 21 are perspective views of the exercise aid to which protrusions according to various embodiments of the present disclosure are coupled.

Referring to FIGS. 20 and 21, the exercise aid 2 may include the protrusions 1100*a* to 1100*d* having various shapes instead of the above-described cradle 1000. Although not illustrated, the protrusions 1100*a* to 1100*d* may have a shape in which one surface protrudes, and a coupling recess (not illustrated) may be formed on an opposite surface, for example, a bottom surface. The coupling recess (not illustrated) may have the same size and shape as the coupling recess 1030 of the above-described cradle. In other words, the coupling recess (not illustrated) may have a size and shape corresponding to the protruding portion 930.

The protrusions 1100*a* to 1100*d* may be coupled to the protruding portion 930 of the above-described frame 900 for the exercise aid and may have various shapes in which one surface protrudes. The user may mount various parts of the user's body on the protrusions.

For example, when the protrusion is used for the neck, the protrusion 1100*a* may have a smooth conical shape as illustrated in FIG. 20.

For example, when the protrusion is used for a local part such as the back or the waist, the protrusion 1100*b*, as illustrated in FIG. 21, may have a star shape, that is, a shape having depressions spaced apart from each other at predetermined intervals on the circular outer surface in a plan view.

Figure 22:
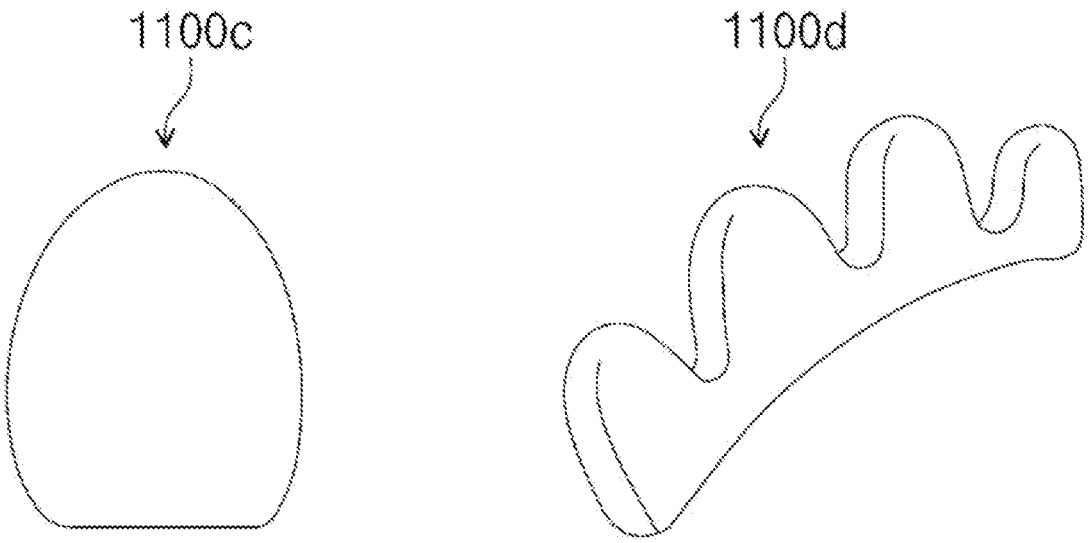
FIG. 22 illustrates protrusions according to various embodiments.

FIG. 22 illustrates protrusions according to various embodiments.

Referring to FIG. 22, when the protrusion is used for the neck, the protrusion 1100*c* may have an egg shape unlike in FIG. 20. Alternatively, when the protrusion is used for the calf, the protrusion 1100*d* may have a shape having depressions spaced apart from each other at predetermined intervals on the circular outer surface in a plan view.

According to the frame 900 for the exercise aid and the exercise aid 2 according to the various embodiments of the present disclosure, the user may fasten the frame 900 for the exercise aid to the support 800 without fastening a separate fixing means and may easily separate the frame 900 for the exercise aid without releasing a separate fixing means. Accordingly, the user may conveniently use the exercise aid 2. In addition, the user may appropriately select the mounting part (e.g., the cradle 1000 and the protrusions 1100*a* to 1100*d*) depending on a part of the user's body that the user wants to mount.

The embodiments of the present disclosure have been described in detail above to allow those skilled in the art to implement and practice the present disclosure. Although the embodiments of the present disclosure have been described above, those skilled in the art will appreciate that various modifications and variations can be made in the present disclosure without departing from the spirit or scope of the present disclosure. Thus, the present disclosure is not intended to be limited to the embodiments described herein, but is intended to accord with the widest scope corresponding to the principles and novel features disclosed herein.

The invention claimed is:

1. An exercise aid comprising:

a support having a semi-cylindrical shape and including a plurality of arch grooves respectively having an arch shape and formed on an outer surface of the support having the semi-cylindrical shape;

a frame for the exercise aid, the frame including a pair of frames having the arch shape, the pair of frames being spaced apart from each other at a predetermined interval and fastened to at least two of the plurality of arch grooves, a bridge provided between the pair of frames and configured to connect the pair of frames, and a protruding portion provided on one surface of the bridge; and a mounting part being fastened to the protruding portion.

2. The exercise aid of claim 1, wherein the support includes support grooves formed in opposite end surfaces of the semi-cylindrical shape and extending from center points of the opposite end surfaces of the semi-cylindrical shape in a vertical direction by a predetermined length.

3. The exercise aid of claim 1, wherein the mounting part includes:

a body having a plate shape and including a mounting pattern formed on one surface thereof; and a coupling recess formed on an opposite surface of the body and coupled with the protruding portion.

4. The exercise aid of claim 1, wherein the mounting part is a protrusion having a shape in which one surface protrudes and including, on an opposite surface thereof, a coupling recess coupled with the protruding portion.

5. The exercise aid of claim 1, wherein the frame for the exercise aid further includes a pair of support members provided at opposite ends of the pair of frames and configured to support the ground.

6. The exercise aid of claim 5, wherein a first pattern groove having a first shape and fastened to a first region on an outer surface of the support is formed on an opposite surface of the bridge configured to face toward a center point of the arch shape, and wherein a pair of second pattern grooves having a second shape and fastened to a second region on the outer surface of the support are formed on surfaces of the pair of support members configured to face toward the center point of the arch shape.

* * * * *